US006726071B2

(12) United States Patent
Baseflug et al.

(10) Patent No.: US 6,726,071 B2
(45) Date of Patent: Apr. 27, 2004

(54) PORTABLE COMPUTER LOCK AND CARRY STRAP

(75) Inventors: Michael Baseflug, Austin, TX (US); Reynold Li Liao, Austin, TX (US); Sean P. O'Neal, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 69 days.

(21) Appl. No.: 10/120,664

(22) Filed: Apr. 11, 2002

(65) Prior Publication Data

US 2003/0192926 A1 Oct. 16, 2003

(51) Int. Cl.[7] ..... E05B 73/00; A45F 3/14

(52) U.S. Cl. ..... 224/258; 70/33; 70/34; 70/58; 190/101; 224/264; 224/255; 224/576; 224/578; 224/584; 224/929; 224/930

(58) Field of Search ..... 224/258, 264, 224/255, 576, 578, 584, 929, 930; 190/101; 70/14, 32, 33, 34, 57, 58; 248/551, 685; 361/686, 726, 732, 747

(56) References Cited

U.S. PATENT DOCUMENTS 5,639,004 A * 6/1997 Carlton et al. ..... 224/930
5,680,977 A * 10/1997 Burke ..... 224/576
5,709,110 A * 1/1998 Greenfield et al. ..... 70/58
5,786,984 A 7/1998 Bonardi et al. ..... 361/686
5,913,907 A * 6/1999 Lee ..... 70/58
6,000,252 A * 12/1999 Murray, Jr. et al. ..... 248/551
6,212,918 B1 * 4/2001 Kravin ..... 70/14
6,297,963 B1 10/2001 Fogle ..... 361/747
6,321,912 B1 * 11/2001 Lippert et al. ..... 224/584
6,331,934 B1 12/2001 Helot et al. ..... 361/686
6,381,127 B1 * 4/2002 Maddali et al. ..... 224/258
6,570,758 B1 * 5/2003 Maeda ..... 361/686
6,578,394 B2 * 6/2003 Yin ..... 70/58
6,588,241 B1 * 7/2003 Murray, Jr. et al. ..... 79/58

* cited by examiner

*Primary Examiner*—Gary E. Elkins
(74) *Attorney, Agent, or Firm*—Hamilton & Terrile, LLP; Robert W. Holland

(57) ABSTRACT

An information handling system lock and carrying strap provides a carrying mode to transport the portable computer and a security mode to secure the portable computer to a fixed object. A cable has attachment devices coupled to each end and operable to couple to a portable computer so that the cable acts as a carrying strap. The cable further secures the information handling system to a fixed device to prevent theft by attaching one cable end to the information handling system and the other end to a fixed object. In one embodiment, the attachment device include a secured unlocked position to allow convenient use as a carrying strap and a secured locked position to allow locking of the device with a key.

12 Claims, 2 Drawing Sheets

PORTABLE COMPUTER LOCK AND CARRY STRAP

BACKGROUND OF THE INVENTION

1. Field of the Invention

The present invention relates in general to the field of information handling systems, and more specifically relates to a system and method for securing and carrying a portable computer.

2. Description of the Related Art

As the value and use of information continues to increase, individuals and businesses seek additional ways to process and store information. One option available to users is information handling systems. An information handling system generally process, compiles, stores and/or communicates information or data for business, personal or other purposes thereby allowing users to take advantage of the value of the information. Because technology and information handling needs and requirements vary between different users or applications, information handling systems may also vary regarding what information is handled, how the information is handled, how much information is processed, stored or communicated, and how quickly and efficiently the information may be processed, stored or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store and communicate information and may include one or more computer systems, data storage systems, and networking systems.

One important improvement for information handling systems is the increased convenience provided by mobile systems, such as portable computers, also known as notebooks or laptops. Portable computers are compact and lightweight to allow users to more easily carry the system while working as compared with desktop computers which are generally tied to a fixed position. Further, wireless networks have provided even greater flexibility by allowing users to maintain communication with a network without a physical connection. Thus users are able to carry portable computers while moving between meetings and rooms with a continuous network connection for accessing work data and e-mail.

One difficulty with portable computers is that, due to their small size and integrated liquid crystal display (LCD), carrying a portable computer can be awkward for the user. Portable computers are susceptible to damage if dropped or carried in an inappropriate manner, such as by an open lid. One option for safer carrying of a portable computer is to place it in its carrying case during movement. However, this reduces the convenience of the user since the portable computer is less easily accessed, takes additional time to pack and unpack in the carrying case, and the carrying case adds to the weight of carrying the portable computer. Another option used in the iBook sold by Apple Computer is to incorporate handles with the housing of the portable computer. However, integrated handles are still inconvenient and awkward to use.

Another difficulty with portable computers is that, due to their small size and generally high value, they are easily stolen or lost. In addition to representing a financial loss, a lost or stolen portable computer often is a substantial setback for its owner since the data on the portable computer is typically valuable and proprietary. To secure a portable computer, a locking device, such as a Kensington lock, is typically included with the portable computer so that a cable may secure the portable computer to a fixed object, such as a desk or wall. However, the lock and cable are typically awkward to carry and therefore are not generally carried by users when working with portable computers in different locations.

SUMMARY OF THE INVENTION

Therefore a need has arisen for a system and method which aids the safe transport of an information handling system, such as a portable computer, by a user in a convenient manner.

A further need exists for a system and method which aids the securing of an information handling system from loss or theft.

In accordance with the present invention, a system and method are provided which substantially reduces the problems and difficulties associated with previous systems and methods for transporting and securing an information handling system. A cable securable to an information handling system also acts as a carrying strap for transporting the information handling system. Thus, a single cable is available to both lock the information handling system and to provide a carrying strap for enhanced mobility.

More specifically, a portable computer is provided with one or more attachment points, such as lock receptors integrated with the housing of the portable computer. One or more attachment devices, such as locking devices, are coupled to a cable and operable to secure to the attachment points. In one embodiment, the cable ends each have a locking device to secure with lock receptors of the portable computer so that the cable provides a shoulder strap or hand grip for transporting the portable computer. Padding encases the cable to provide comfort and a secure support for a user when transporting the portable computer. The portable computer is then secured to a fixed object by releasing a locking device from a lock receptor and securing the locking device to a lock receptor associated with the fixed device. Alternatively, the cable includes a loop having a diameter sufficient to accept an end of the cable so that the cable is secured to a fixed object by wrapping the cable around the fixed object and securing one or both locking devices to lock receptors of the portable computer.

In one specific embodiment, each cable end couples to a multiple position Kensington lock device. The Kensington locks include a rotationally coupled slot catch that inserts into a slot receptor integrated with the portable computer housing. The Kensington slot receptors are integrated in opposing sides of the portable computer housing so that the cable attaches as a carrying strap that allows hands-off carrying of the portable computer. The Kensington locks attach in a first unlocked position without the use of a key and a second locked position with the use of a key so that a user may easily attach and detach the cable when used as a carrying strap and use the key when securing the portable computer. In one alternative embodiment, the cable couples to the Kensington locks with a loop so that a single Kensington lock may secure the portable computer. In another embodiment, the cable is also used as the carrying strap for the portable computer's carrying case. For instance, the carrying case includes Kensington lock receptors to accept the Kensington lock catches or clips to clip to the loops.

The present invention provides a number of important technical advantages. One example of an important technical advantage is that a user may carry an information handling system in a convenient, safe and hands-off manner. By using the locking cable as a carrying strap, users may easily transport a portable computer with increased comfort and reduced risk of damage. Further, a two position locking device provides convenience for using the carrying strap without the use of a key.

Another example of an important technical advantage is that security of information handling systems is enhanced by allowing users to carry information handling systems with a security cable so that the security cable is readily accessible for securing the information handling system. For example, a user carries a portable computer with a cable by attaching one or both ends of the cable to attachment points of the portable computer. When the user reaches the destination, the carrying strap is available to be detached, secured to a fixed object then reattached in a locked position without requiring the user to carry separate security devices.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A dual purpose securing cable and carrying strap improves mobility and security for information handling systems. For purposes of this disclosure, an information handling system may include any instrumentality or aggregate of instrumentalities operable to compute, classify, process, transmit, receive, retrieve, originate, switch, store, display, manifest, detect, record, reproduce, handle or utilize any form of information, intelligence, or data for business, scientific, control or other purposes. For example, an information handling system may be a personal computer, a network storage device, or any other suitable device and may vary in size, shape, performance, functionality and price. The information handling system may include random access memory (RAM), one or more processing resources such as a CPU, or hardware or software control logic, ROM and/or other types of nonvolatile memory. Additional components of the information handling system may include one or more disk drives, one or more network ports for communicating with external devices as well as various input and output (I/O) devices, such as a keyboard, a mouse and a video display. The information handling system may include one or more buses operable to transmit communications between the various hardware components.

Figure 1:
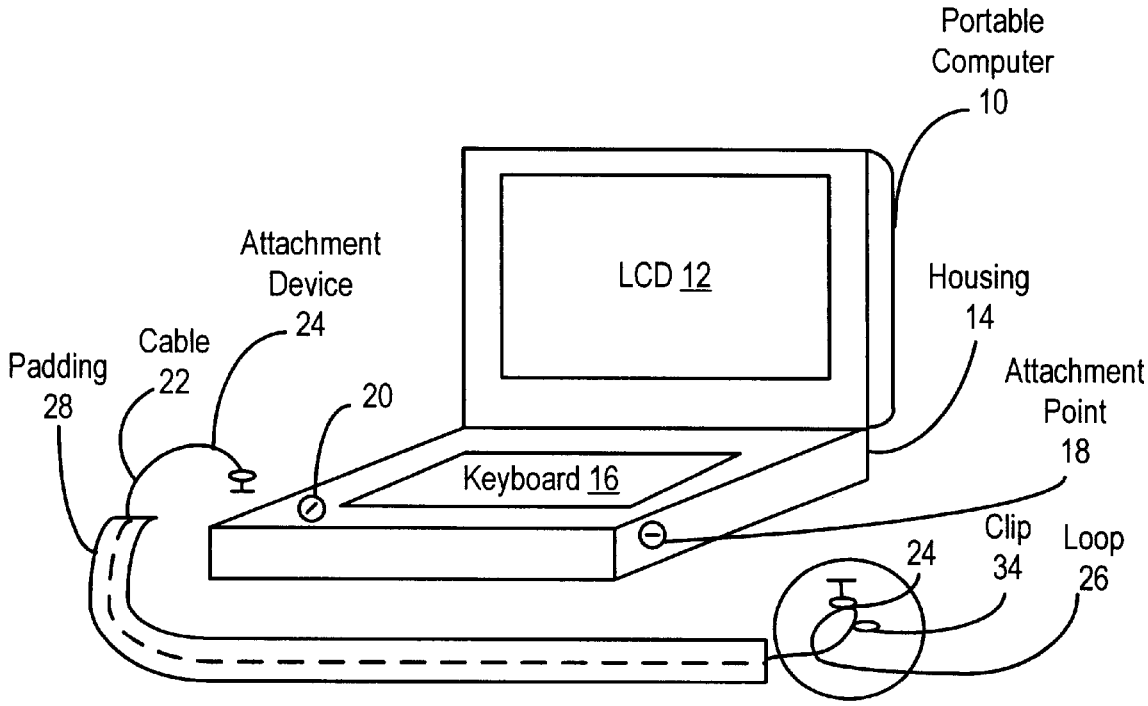
FIG. 1 depicts a side perspective view of a portable computer with a dual mode lock and carrying strap.

Referring now to FIG. 1, one embodiment of the present invention is depicted in use with a portable computer 10 having a liquid crystal display (LCD) 12 rotationally coupled to a housing 14, such as with hinges that allow LCD 12 to rotate to a closed position that covers keyboard 16. An attachment point 18 is depicted as integrated along one side of housing 14 so that it is exposed in both the open and closed position of LCD 12. Another attachment point 20 is depicted as integrated along the upper surface of housing 14 on an opposing end of housing 14 from attachment point 18. In various embodiments, attachment points are disposed at various locations of portable computer 10 for the convenience of the user and to provide balanced carrying points with LCD 12 in open and closed positions. Further, attachment points are disposed at various locations to enhance security of the portable computer, such as by integration with hardware devices, such as the hard drive.

A cable 22 provides dual roles of securing portable computer 10 and acting as a carrying strap to transport portable computer 10. Each end of cable 22 has an attachment device 24 that attaches to attachment points 18 or 20. One end of cable 22 includes a loop 26 having a diameter of sufficient size to accept the other end through it, including padding 28 that encases cable 22. Padding 28 provides comfort for a user who supports the weight of portable computer 10 with cable 22. For instance, attachment devices 24 are attached to attachment points 18 and 20 allowing a user to carry portable computer 10 by using cable 22 and padding 28 as a shoulder strap or handgrip. In one embodiment, padding 28 is removable, such as with Velcro that secures it around cable 22, so that cable 22 is selectively less bulky.

Figure 2:
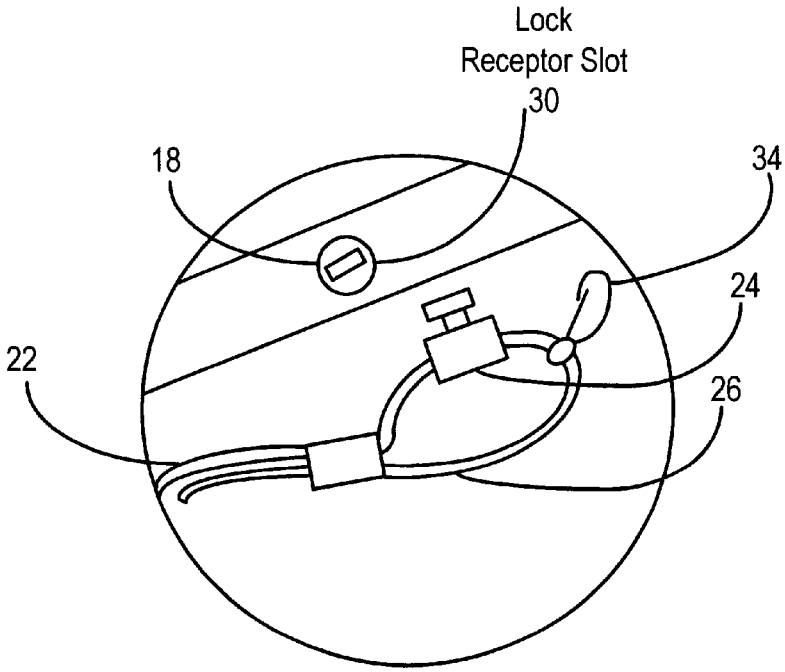
FIG. 2 depicts a blow up view of an attachment point for dual mode lock and carrying strap.

Referring now to FIG. 2, a blow-up view of an attachment point 18 and attachment device 24 are depicted. Attachment device 18 has a lock receptor slot 30 that accepts a slot catch 32 of attachment device 24. To attach cable 22 to portable computer 10, slot catch 32 is inserted into lock receptor slot 30 and rotated to prevent detachment. For instance, attachment device 24 is a Kensington lock such as is typically used to secure portable computers. FIG. 2 also depicts a clip 34 as an alternative attachment device. For instance, in an alternative embodiment, clip 34 attaches to a ring attachment point of portable computer 10 to allow simple and quick attachment of cable 22.

Figure 3:
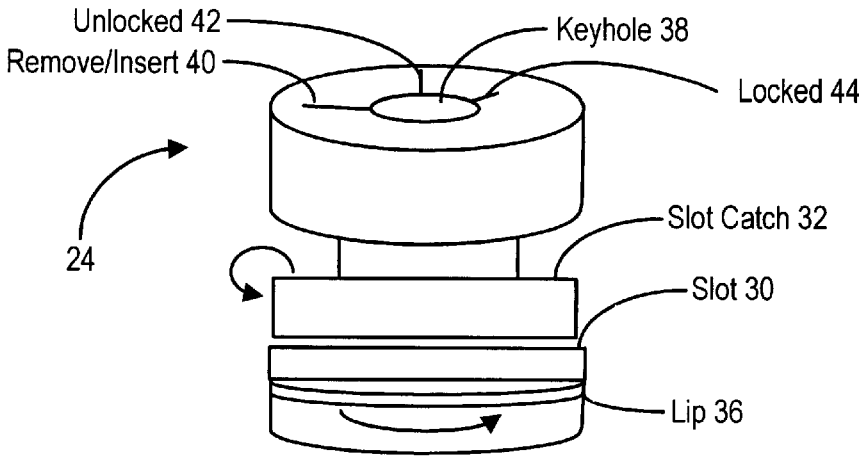
FIG. 3 depicts a blow up view of a dual position Kensington lock and receiving slot.

Referring now to FIG. 3, a cutaway view of a Kensington lock attachment device 24 depicts a multi-position embodiment. Attachment device 24 has a slot catch 32 that inserts into slot 30. Once inside slot 30, slot catch 32 rotates underneath a lip 36 by activation of attachment device 24 to prevent removal of slot catch 32 though slot 30. For instance a key fits into a keyhole 38 to lock the position of slot catch 32 so that attachment device 24 is in a locked and secured position removable only by activation of the key to unlock attachment device 24. Alternatively, a non-key activated movement of attachment device 24 allows selection of a secure and unlocked position so that attachment device 24 may be attached and detached without the use of a key. For instance, attachment device 24 is aligned in a remove/insert position 40 that aligns slot catch 32 with slot 30 to allow removal and insertion of slot catch 32 into slot 30. Attachment device 24 rotates by hand movement to an unlocked secure position 42 that places slot catch 32 under lip 36 for securing attachment device 24 to portable computer 10. Movement to and from the unlocked position does not require key activation and the unlocked position is held in place, such as by a spring-loaded catch, to prevent inadvertent movement. Attachment device 24 rotates by key movement to a locked secure position 44 that places slot catch 32 underneath lip 36 for securing attachment device 24 to portable computer 10. The locked position prevents removal of attachment device 24 without key activation.

Figure 4:
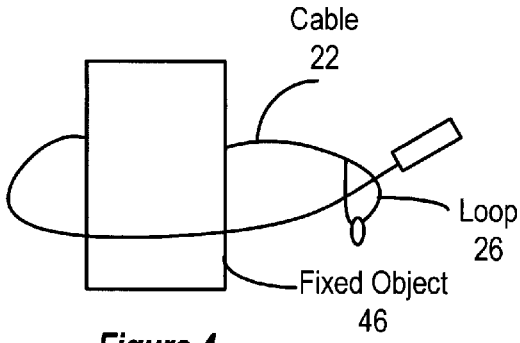
FIG. 4 depicts the cable secured to a fixed object.

When a user needs to transport portable computer 10, such as to attend a meeting in another room, the user attaches cable 22 to portable computer 10 by securing attachment devices 24 to attachment points 18 and 20. Alternatively, the user may carry portable computer 10 with a single attachment point by running cable 22 through loop 26. Cable 22 acts as a carrying strap, such as a shoulder strap, that provides hands-off secure transportation in a convenient manner. Use of unlocked secure position 42 allows convenient attachment and removal of cable 22 without the need to remember a key so that, once a user arrives at a destination, cable 22 is easily removed to provide unhindered access to portable computer 10. However, the user may also secure portable computer 10 in a locked position to prevent theft. For instance, referring now to FIG. 4, the user may insert an end of cable 22 through loop 26 so that cable 22 is secured to a fixed object 46. The attachment device associated with the inserted end of cable 22 is then secured to portable computer 10 in a locked position, thus securing portable computer 10 to the fixed object. Alternatively, cable 22 may be wrapped around fixed object 46 and attached at both ends to attachment points of portable computer 10 in locked positions. In another alternative embodiment, one end of cable 22 may be attached in a locked position to portable computer 10 and the other end attached in a locked position to an attachment point associated with a fixed object 46 or another information handling system. When secured to a fixed object, padding 28 may be removed from cable 22 to reduce the area taken up.

Figure 5:
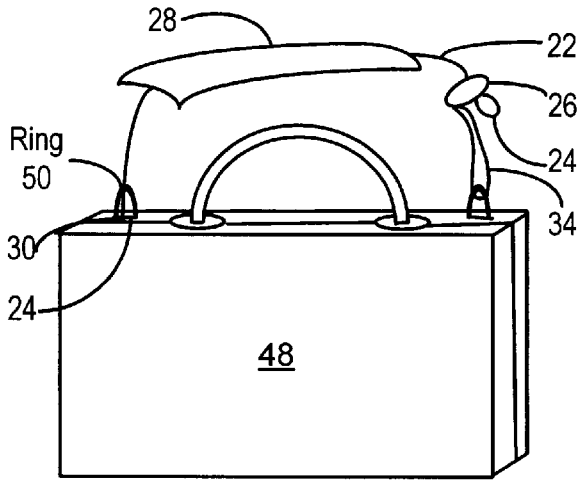
FIG. 5 depicts a side perspective view of a carrying case with a dual mode lock and carrying strap.

Dual use of cable 22 as a carrying strap and security device enhances mobility and security of information handling systems in a manner that is convenient to users. For instance, dual use of cable 22 reduces overall weight and bulkiness of an information handling system and reduces the risk of lost or stolen systems by encouraging users to carry the information handling system with its security system. In one embodiment, depicted in FIG. 5, cable 22 may also act as a carrying strap for a portable computer carrying case 48. For instance, a clip 34 attaches to hooks 50 of carrying case 48 or a Kensington lock attachment device 24 attaches to lock receptors slots 30 integrated with carrying case 48. Thus, improved mobility and security is made available when a user travels with carrying case 48.

Although the present invention has been described in detail, it should be understood that various changes, substitutions and alterations can be made hereto without departing from the spirit and scope of the invention as defined by the appended claims.

What is claimed is:

1. A system for securing and carrying a portable computer, the system comprising:

first and second lock receptors integrated with the portable computer;

a carrying strap having first and second ends;

a first looking device coupled to the first carrying strap end; and a second locking device coupled to the second carrying strap end;

wherein the first and second locking devices are operable to secure to the first and second lock receptors so that the carrying strap is operable to carry the portable computer.

2. The system of claim 1 wherein the first and second locking devices each have a non-secure locking position and a secure locking position.

3. The system of claim 1 wherein the carrying strap comprises a cable encased in padding.

4. The system of claim 3 wherein the cable has a length, the length sufficient to allow the carrying strap to act as a shoulder strap.

5. The system of claim 3 wherein the cable has a length, the length adapted to allow the carrying strap to act as a hand grip.

6. The system of claim 1 wherein the carrying strap comprises a cable having a loop at the first end, the loop having a diameter sufficient to accept the second end of the cable for securing the cable to an object and to the portable computer.

7. An information handling system comprising:

a housing having electronic components for processing information;

a first and second attachment points integrated with the housing;

a cable having first and second ends;

an attachment devices coupled to each of the first and second cable ends and operable to secure to the attachment points;

a loop associated with the second cable end and operable to accept the first cable end to secure the cable around an object; and padding encasing a segment of the cable between the first and second cable ends, the padding operable to act as a shoulder strap for moving the information handling system.

8. The system of claim 7 wherein at least one attachment device comprises a lock.

9. The system of claim 7 wherein at least one of the attachment devices comprises a two position device, the first position securing and releasing to the attachment point without a key, the second position securing and releasing the attachment device to the attachment point with a key.

10. The system of claim 7 wherein the information handling system is a portable computer, the system further comprising a carrying case for the portable computer, the cable further operable to attach to the carrying case as a shoulder strap.

11. The system of claim 7 wherein at least one attachment device comprises a clip operable to clip to an attachment point.

12. The system of claim 7 wherein the attachment points comprise lock receptors and the attachment device comprises a locking device.

* * * * *